United States Patent [19]

Scheurecker et al.

[11] Patent Number: 4,544,015

[45] Date of Patent: Oct. 1, 1985

[54] CONTINUOUS CASTING PLANT

[75] Inventors: Werner Scheurecker, Linz; Karl Holzer, Stadt Haag; Kurt Engel, Leonding; Hermann Schubert, Linz, all of Austria

[73] Assignee: Voest-Alpine Aktiengesellschaft, Linz, Austria

[21] Appl. No.: 455,813

[22] Filed: Jan. 5, 1983

[30] Foreign Application Priority Data

Jan. 12, 1982 [AT] Austria ..... 80/82

[51] Int. Cl.[4] ..... B22D 11/12

[52] U.S. Cl. ..... 164/442; 164/448

[58] Field of Search ..... 164/436, 441, 442, 447, 164/448, 418, 484

[56] References Cited

U.S. PATENT DOCUMENTS

| | | | |
|---|---|---|---|
| 3,447,591 | 6/1969 | Foldessey | 164/442 |
| 4,085,793 | 4/1978 | Scheinecker et al. | 164/436 |
| 4,428,415 | 1/1984 | Scheurecker et al. | 164/448 |

*Primary Examiner*—Nicholas P. Godici
*Assistant Examiner*—Richard K. Seidel
*Attorney, Agent, or Firm*—Brumbaugh, Graves, Donohue & Raymond

[57] ABSTRACT

A continuous casting plant includes supporting elements following a through-type mould and including the strand guideways. The elements are arranged within a cooling chamber and are fastened to a supporting structure so as to be adjustable relative to the through-type mould and relative to one another in the direction transversely to the longitudinal axis of the strand guideways. In order to be able to carry out an aligned adjustment between the mould and the supporting elements in a simple manner, with little work to carry out and even with the plant in operation, wherein the entry of the cooling chamber is avoided, at least one of the supporting elements is coupled with an adjustment means. This adjustment means is fastened to a supporting structure, directed outwardly from the cooling chamber and actuatable from outside of the cooling chamber.

9 Claims, 3 Drawing Figures

CONTINUOUS CASTING PLANT

BACKGROUND OF THE INVENTION

The invention relates to a continuous casting plant, in particular an arcuate continuous casting plant for steel strands, comprising supporting elements following a through-type mould and including the strand guideways, which elements are arranged within a cooling chamber and are fastened to a supporting structure so as to be adjustable relative to the through-type mould and relative to one another in the direction transversely to the longitudinal axis of the strand guideways.

A continuous casting plant of this type is known from Austrian patent No. 364,980. For the purpose of an aligned adjustment of their rollerways, all the supporting elements are mounted so as to be adjustable either relative to a stationary supporting structure, for instance relative to the base, or at one another, so that the strand guideways are adjustable transversely to their longitudinal axes. Of a particular importance is the precise adjustment of the first supporting element, which is closely below the mould and, in arcuate continuous casting plants comprising a straight mould, is designed as the bending zone, since the strand has a very thin strand skin prone to cracks closely below the mould. An offset between the bending zone and the mould (or its foot rollers) or between the bending zone and the subsequent circularly arcuate guiding arc may lead to a strand breakthrough.

From U.S. Pat. No. 4,129,173 it is known to fasten the bending zone to the stationary supporting structure by interposing shims, so that the bending zone can be precisely adjusted relative to a subsequently arranged supporting element. The aligning adjustment of the supporting elements in the plant, however, causes difficulties, since the elements are inserted within the cooling chamber. Therefore, it is necessary to enter the cooling chamber and to carry out adjustment and reassemblage works within the cooling chamber, which are cumbersome to carry out, in particular if the plant parts are hot. Moreover, it may be necessary to remove parts of the cooling chamber.

A further problem arises in continuous casting plants in which individual supporting elements cannot be displaced transversely to the longitudinal axis of the strand guideway, since they are bound, with regard to their positions, to connection plates available for coolants and/or lubricants. With such plants it would be necessary to offset the supporting elements commonly with their connection plates, which is very cumbersome to carry out, if possible at all.

The invention aims at avoiding these disadvantages and difficulties and has as its object to provide a continuous casting plant in which an aligned adjustment between its supporting elements, or the mould and the supporting elements, may be realized in a simple manner, with little work to carry out and even with the plant in operation, under normal working conditions, wherein the entry of the cooling chamber is avoided and, if desired, one of the supporting elements, for instance the mould, may retain its position, i.e., need not perform adjusting movements transversely to the longitudinal axis of the strand guideway.

SUMMARY OF THE INVENTION

This object of the invention is achieved in that, for an adjustment transversely to the longitudinal axis of the strand guideways, at least one of the supporting elements is coupled with an adjustment means fastened to a supporting structure, directed outwardly from the cooling chamber and actuatable from outside of the cooling chamber, such as a threaded bolt, a toothed rack, etc., the adjustment means advantageously being coupled with the supporting element via a lever hinged to the supporting structure, preferably a lever comprising two unequal arms.

With a continuous casting plant comprising a straight through-type mould and a bending zone arranged therebelow and followed by a supporting element including a circularly arcuate strand guideway, both the strand run-in end and the strand run-out end of the bending zone are each coupled with an adjustment means, according to an advantageous embodiment. This embodiment has the advantage that the mould need not be detached from the lifting table and displaced relative to the lifting table for the aligned adjustment relative to the supporting elements.

A further preferred embodiment of a continuous casting plant comprising a straight through-type mould and a bending zone arranged therebelow and followed by a supporting element including a circularly arcuate strand guideway and having arcuate longitudinal carriers extending over its length in one piece and carrying supporting rollers, is characterized in that the lower end of the bending zone is articulately fastened to the supporting element following it and the upper end of the bending zone is coupled with the adjustment means. With a continuous casting plant of this kind it is merely required to align the upper end of the bending zone relative to the mould, which need not be aligned for the purpose of an aligned adjustment of the supporting elements. The lower end of the bending zone, on account of the articulate mounting on the arcuate longitudinal carriers carrying one of the rollerways, is in a precisely adjusted position relative to the circular-arc way following the bending zone even in the event of slight pivotal movements of the bending zone. It is advantageous, if the adjustment means is coupled with the bending zone via a lever hinged to longitudinal carriers.

For a continuous casting plant for billets or blooms, comprising a through-type mould flanged to a vertical reciprocating flange plate, a bending zone provided below the through-type mould and a supporting element following the bending zone and including a circularly arcuate strand guideway, the bending zone, according to a preferred embodiment, is hinged with its lower end to the supporting element following it, the bending zone being coupled with the adjustment means near its upper end.

BRIEF DESCRIPTION OF THE DRAWING

The invention will now be explained by way of several embodiments and with reference to the accompanying drawings, wherein.

DESCRIPTION OF EXEMPLARY EMBODIMENTS

Figure 1:
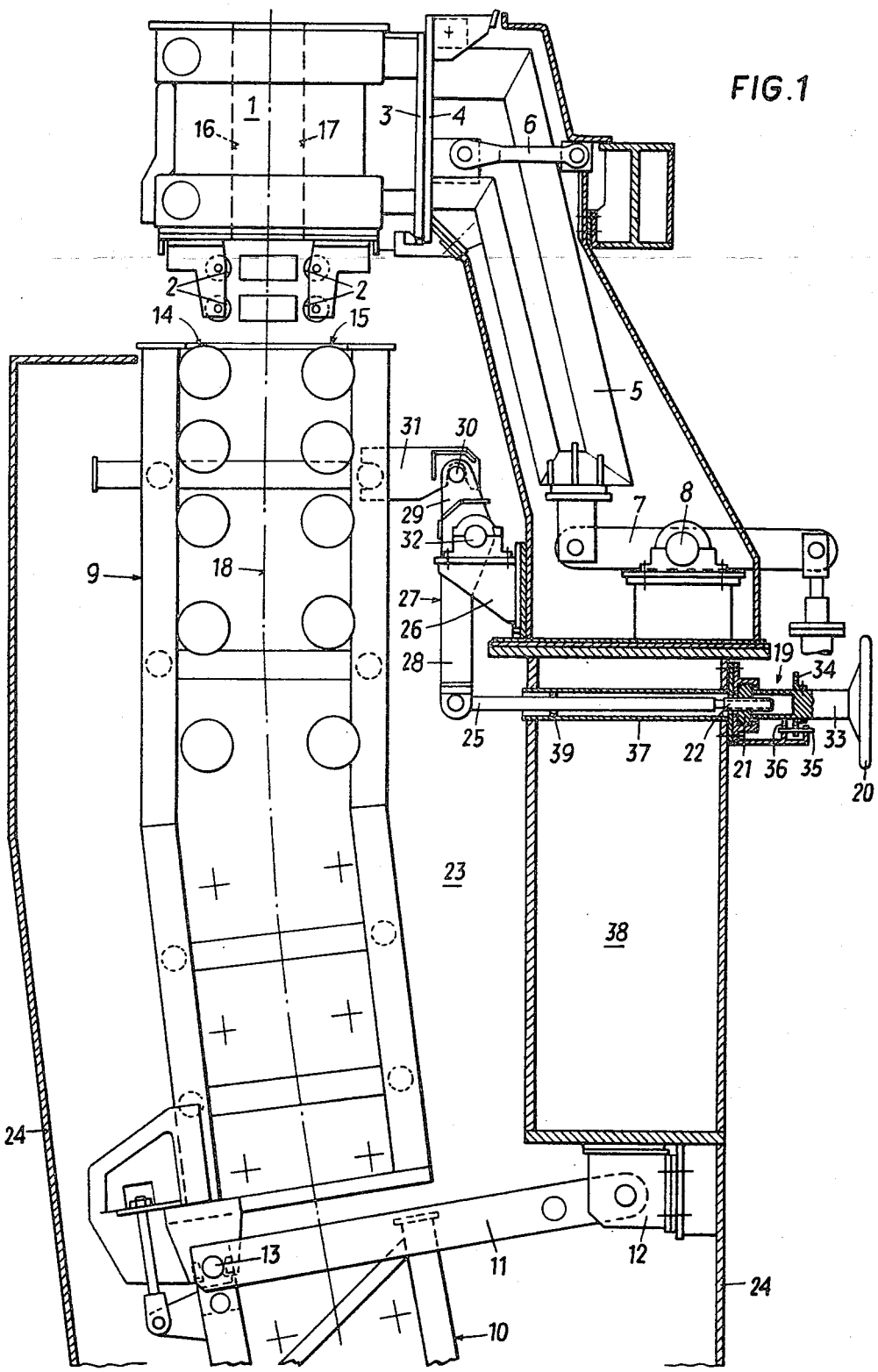
FIG. 1 is a partially sectioned schematic illustration of a side view of a continuous casting plant for blooms constructed in accordance with the present invention.

According to the embodiment illustrated in FIG. 1, a straight through-type mould 1 of a bloom continuous casting plant, which is provided with foot rollers 2 on its lower end, comprises a vertical flange plate 3. By this flange plate 3, the mould is clamped to a vertically reciprocating flange plate 4 of a mould carrier 5 also vertically reciprocating. These flange plates 3, 4 have openings for the cooling medium flowing in and out, so that the through-type mould 1 automatically is connected to the supply conduits after having clamped the flange plate 3 to the reciprocating flange plate 4. The reciprocation means is comprised of a four-bar linkage whose oscillating cranks are denoted by 6, 7. One of the oscillating cranks is elongated beyond its stationary hinge point 8 and is set in reciprocating movements by means of a reciprocation drive.

Below the through-type mould 1, i.e., below its foot rollers 2, a supporting element 9 bending the strand in a circularly arcuate manner is arranged, which is denoted as bending zone in the following. The bending zone 9 is followed by a supporting element 10 with circularly arcuate strand guideways. This cage-like supporting element 10 is suspended on a stationary supporting structure 12 by means of a bracket 11. On the upper end of the supporting element 10 carrying the circularly arcuate strand guideways, the bending zone 9 is articulately fastened, i.e. by means of a pin 13, so that the bending zone can be pivoted about this pin.

The bending zone 9 is pivoted about the pin 13 until its rollerways 14, 15 are in alignment with the corresponding side walls 16, 17 of the through-type mould, and the foot rollers 2 of the through-type mould. To carry out this adjusting movement—the upper end of the bending zone 9 in this case moves transversely to the longitudinal axis 18 of the strand guideways 14, 15—an adjustment means 19 serves, which is comprised of a handwheel 20 and a nut 21 mounted on this handwheel, a threaded bolt 22 engaging in the nut. The handwheel 20, the nut 21 and the threaded bolt 22 are outside of the schematically illustrated cooling chamber wall 24 delimiting the cooling chamber space 23. The threaded bolt is elongated in the direction towards the bending zone and, on its end 25, is hinged to a lever 27 articulately mounted on a stationary console 26. This lever 27 comprises two arms 28, 29 that are unequally long. The longer arm 28 is directed to the threaded bolt 22 and hinged thereto; the shorter arm 29, with a hinge pin 30, engages in a fork 31 fastened to the upper end of the bending zone. By turning the handwheel 20, the lever 27 can be pivoted about its pivot axis 32, whereby the upper end of the bending zone 9 can be pivoted about the pin 13.

This construction has the advantage that any adjustment work can be carried out in a simple manner from outside of the cooling chamber 23, 24, the through-type mould 1 itself not having to be displaced. Consequently, adjustment operations at the flange plates 3, 4 are eliminated, and the tightness of the cooling water supplies and discharges remains safeguarded.

For fixing the handwheel 20 (and thus the bending zone 9) in a certain position, a punched disk 34 is fastened to its axis 33, through which a fixing pin 35 can be stuck, the fixing pin penetrating two openings provided in stationary consoles 36. In order to prevent water or steam from getting to the nut 21 and to the threaded bolt 22, the threaded bolt is inserted in a tube 37 welded into a cross carrier 38 of the stationary supporting structure 12 and is sealed relative to the tube 37 by means of a seal 39.

Figure 2:
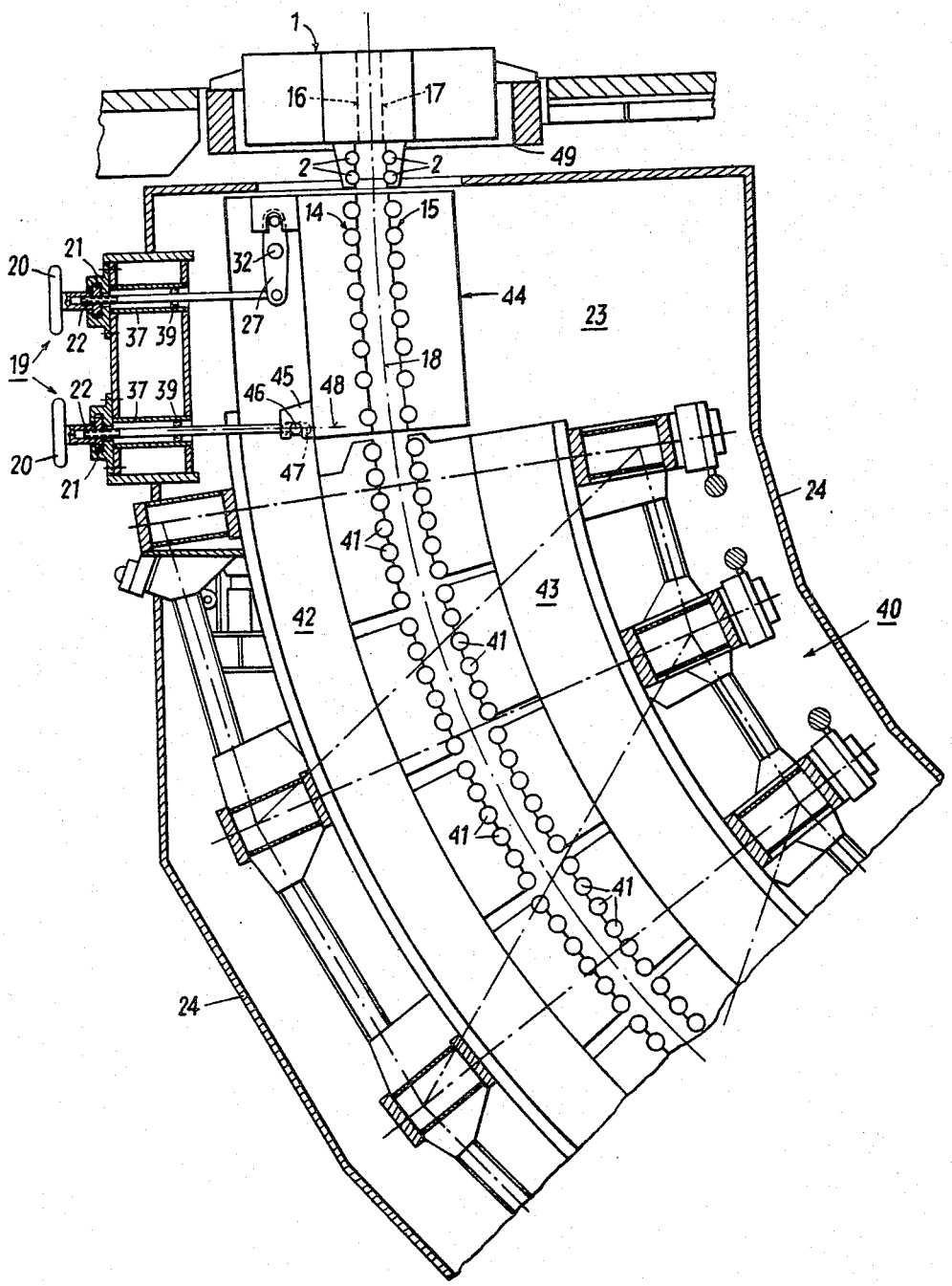
FIG. 2 is a partially sectioned schematic illustration of a side view of a continuous casting plant for slabs constructed in accordance with the present invention.

The embodiment illustrated in FIG. 2 concerns an arcuate continuous casting plant for slabs, wherein a supporting element 40 including circularly arcuate strand guideways comprises arcuate longitudinal carriers 42, 43 carrying the arc inner-side and arc outer-side supporting rollers 41. The arc outer-side arcuate longitudinal carriers 42 are elongated upwardly in the direction towards the through-type mould 1. The bending zone 44, with its lower end, is hinged to a pin 46 that engages in a console 45 of the bending zone 44, which pin 46 is guided along a slot 47 of the arcuate longitudinal carrier 42. The longitudinal axis 48 of the longhole 47 is approximately transverse to the longitudinal axis 18 of the rollerways 14, 15. This pin 46 immediately is contacted by an adjustment means 19, which is designed similar to the adjustment means 19 illustrated in FIG. 1, so that the lower end of the bending zone 44 is displaceable approximately in the direction transversely to the longitudinal axis 18. Thereby the lower end of the bending zone may be adjusted so as to be in strict alignment with the circularly arcuate guiding arc.

The upper end of the bending zone 44 also is coupled with an adjustment means 19, a lever 27 being provided between the adjustment means 19 and the upper end of the bending zone 44, which lever is designed like the lever 27 according to FIG. 1. However, the lever is not hinged to a stationary supporting structure 12 (as illustrated in FIG. 1), but the pivot axis 32 of the lever 27 is arranged on the arc outer-side arcuate longitudinal carriers 42 elongated upwardly as far as to the through-type mould 1. The adjustment means 19 also is designed similar to the adjustment means illustrated in FIG. 1. By this embodiment it is not only possible to align the bending zone with the neighboring supporting elements, i.e. with the through-type mould and the supporting element 40, thus preventing a roller offset, but it is also possible to align the bending zone such that its strand guideways verge into the circularly arcuate strand guideways of the supporting element 40 without break, which is of a particular importance to strands having slab cross sections. In this case, the through-type mould 1 is aligned according to the position of the bending zone 44 only after the adjustment of the bending zone, and fastened to its lifting table 49.

Figure 3:
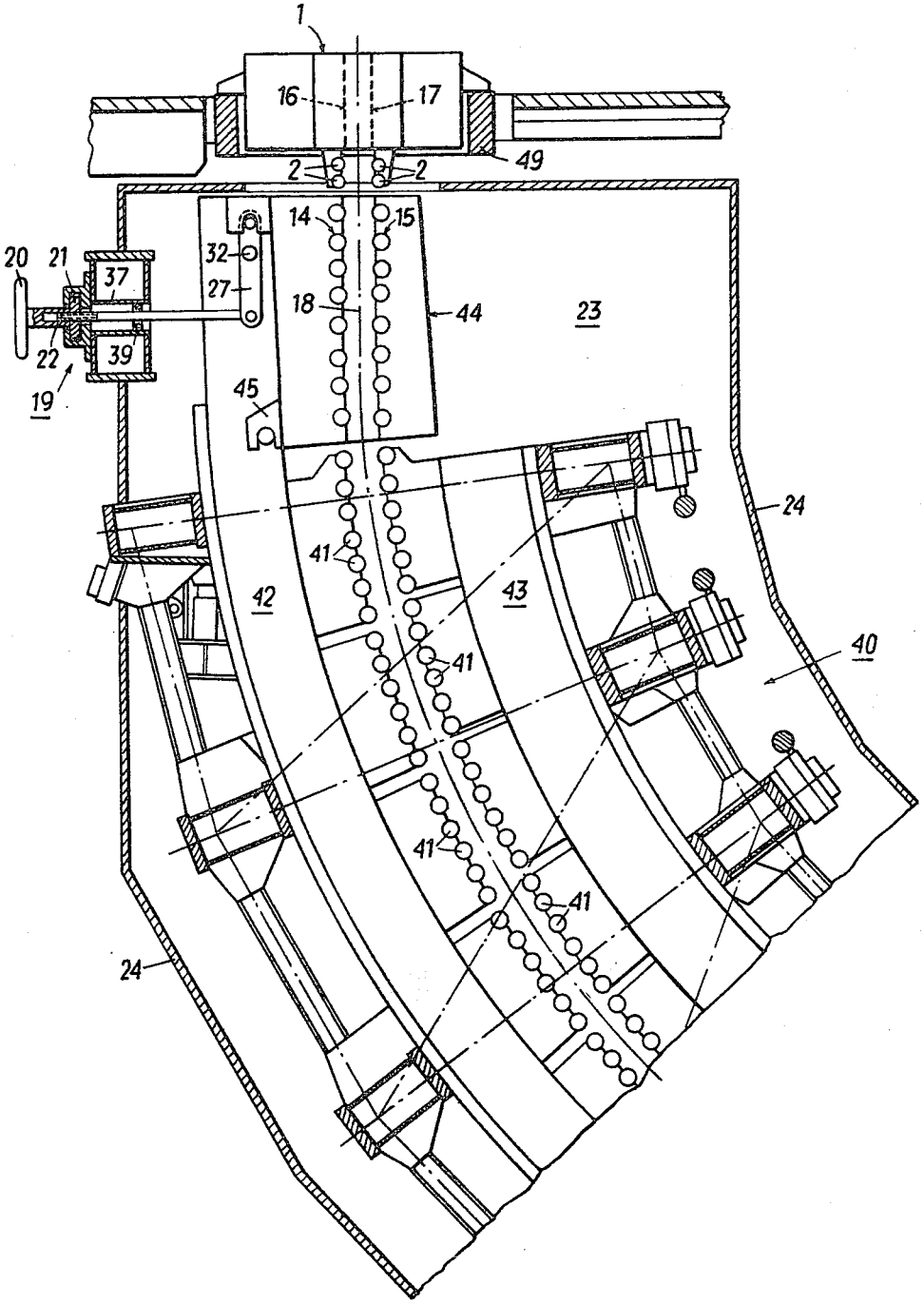
FIG. 3 represents a further embodiment of the present invention in an illustration analogous to FIG. 2.

The embodiment illustrated in FIG. 3 basically is the same as illustrated in FIG. 2, however with the difference that the lower end of the bending zone 44 is not displaceable relative to the circularly arcuate supporting element 40. The bending zone 44 is articulately mounted merely on the arc outer-side arcuate longitudinal carrier 42 elongated as far as to approximately the height of the through-type mould 1.

What we claim is:

1. In a continuous casting plant, in particular an arcuate continuous casting plant for steel strands, of the type including, a through-type mould, supporting elements following said mould and including strand guideways having a longitudinal axis, a stationary cooling chamber surrounding said supporting elements, and a stationary structure to which said supporting elements are connected, at least one of said supporting elements being movable relative to said mould and to another of said supporting elements in a direction transverse to said longitudinal axis of said strand guideways, the improvement comprising;

at least one means for adjusting the position of said at least one supporting element from outside of said cooling chamber, said adjusting means including a variably movable adjustment member mounted exteriorly of said cooling chamber, actuating means coupled to said adjustment member and extending into said cooling chamber, and means coupling said actuating means to said at least one supporting element for displacing said supporting element within said cooling chamber transversely to said longitudinal axis by amounts selectively determined by the extent of movement of said adjustment member, whereby said at least one supporting element may be aligned relative to said mould and said another said supporting element along said longitudinal axis by controlled movement of said adjustment member.

2. A continuous casting plant as set forth in claim 1, wherein said actuating means includes a threaded bolt.

3. A continuous casting plant as set forth in claim 1, wherein said actuating means includes a toothed rack.

4. A continuous casting plant as set forth in claim 1, wherein said means for coupling said actuating means to said at least one supporting element includes a lever hinged to said supporting structure.

5. A continuous casting plant as set forth in claim 4, wherein said lever is comprised of two unequal arms.

6. A continuous casting plant as set forth in claim 1, 4 or 5, wherein said mould is a straight through-type mould, wherein one of said supporting elements comprises a bending zone arranged below said mould and having a strand run-in end and a strand run-out end, and wherein the supporting element following said bending zone includes a circularly arcuate strand guideway, a first adjusting means being coupled with said strand run-in end of said bending zone and a second adjusting means being coupled with said strand run-out end of said bending zone.

7. A continuous casting plant as set forth in claim 1, 4 or 5, wherein said mould is a straight through-type mould, wherein one of said supporting elements comprises a bending zone arranged below said mould and having a lower end and an upper end, and wherein the supporting element following said bending zone includes a circularly arcuate strand guideway having one-piece arcuate longitudinal carriers extending over the length of said supporting element and carrying supporting rollers, wherein said lower end of said bending zone is articulately fastened to said supporting element following it, and wherein said upper end of said bending zone is coupled with said adjusting means.

8. A continuous casting plant as set forth in claim 7, wherein said means for coupling said adjusting means to at least one of said supporting elements includes a lever hinged to said arcuate longitudinal carriers and coupled with said bending zone.

9. A continuous casting plant as set forth in claim 6 wherein said steel strands are one of billets and blooms, further comprising a vertical reciprocating flange plate carried by a mould carrier, said through-type mould also including a flange plate coupled with said mould carrier flange plate, wherein the supporting element arranged below said through-type mould comprises a bending zone having a lower end and an upper end, and wherein the supporting element following said bending zone includes a circularly arcuate strand guideway, the lower end of said bending zone being hinged to said supporting element following it, and said bending zone, near its upper end, being coupled with said adjusting means.

* * * * *